US011708701B1

(12) United States Patent
Erbes

(10) Patent No.: US 11,708,701 B1
(45) Date of Patent: Jul. 25, 2023

(54) SWIMMING POOL SKIMMER WITH ADJUSTABLE FACE

(71) Applicant: Jeremy Erbes, Scottsdale, AZ (US)

(72) Inventor: Jeremy Erbes, Scottsdale, AZ (US)

( * ) Notice: Subject to any disclaimer, the term of this patent is extended or adjusted under 35 U.S.C. 154(b) by 124 days.

(21) Appl. No.: 17/227,198

(22) Filed: Apr. 9, 2021

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.1, 776
See application file for complete search history.

(56) References Cited

U.S. PATENT DOCUMENTS

| | | | | |
|---|---|---|---|---|
| 9,890,547 | B1 * | 2/2018 | Sirco | E04H 4/1272 |
| 10,876,314 | B1 * | 12/2020 | Sirco | E04H 4/1272 |
| 2002/0121467 | A1 * | 9/2002 | Watson | E04H 4/1272 210/167.1 |
| 2005/0211614 | A1 * | 9/2005 | Boggs | E04H 4/1272 210/167.1 |
| 2017/0121994 | A1 * | 5/2017 | Keeler | E04H 4/1272 |

FOREIGN PATENT DOCUMENTS

| | | | |
|---|---|---|---|
| EP | 2730725 | A1 * | 5/2014 |
| GB | 1589370 | A * | 5/1981 |

OTHER PUBLICATIONS

Machine-generated English translation of EP 2730725, generated on Oct. 3, 2022.*

* cited by examiner

*Primary Examiner* — Fred Prince
(74) *Attorney, Agent, or Firm* — Messner Reeves LLP

(57) ABSTRACT

An interface module of a skimmer for a swimming pool or spa includes an adjustable face assembly that rotatably adjusts within an angular range, inward and/or outward with respect to vertical, that includes the expected possible angles of the pool wall, to provide a substantially planar mounting surface that is parallel to the wall of the swimming pool or spa. A waterproof shroud interconnects mounting brackets of the assembly, expanding and contracting as the mounting brackets are rotated relative to each other. The assembly can be integrated with the skimmer during manufacture of the skimmer, or poolside during skimmer installation. The installer positions the assembly approximate a skimmer aperture in the pool wall, actuates the adjustment mechanism of the interface module to select and lock the desired angle, and secures the interface module flush against the angled pool wall, with the throat module and vessel of the skimmer remaining upright.

20 Claims, 18 Drawing Sheets

SWIMMING POOL SKIMMER WITH ADJUSTABLE FACE

FIELD OF INVENTION

This invention relates to swimming pool skimmers for fiberglass swimming pools, and more particularly to skimmers that mount to the swimming pool wall during installation.

BACKGROUND

A skimmer is a cleaning device for swimming pools and spas that removes debris from the surface of the water. Most pools and spas have at least one skimmer permanently installed through the pool wall, with the mouth of the skimmer vertically centered at the waterline. The skimmer has a filtration vessel and a throat module extending from the vessel; during installation near the pool/spa, the vessel is connected in fluid communication with the pool's filtration, cleaning, and/or circulation system (i.e., to the suction side of the system, via pipes that connect to ports in the bottom of the vessel; see FIG. 1). The throat module includes a chamber that is open at both ends and extends from one end interfacing the vessel, through the pool wall to the opposite end, forming a mouth approximate the pool wall. The water level of the pool, in its normal range, falls between the top and bottom walls of the chamber, so that water may flow from the pool through the chamber to the vessel. A weir disposed in the chamber allows a thin layer of surface water to flow over it, carrying the debris at velocity toward the vessel, but the weir prevents backflow of the water into the pool.

The throat module is securely and rigidly fastened to, and sometimes integral with, the vessel, with the axis of the chamber and the axis of the vessel perpendicular to each other; as such, the extreme end of the throat module is an attachment point that must be secured during installation. The throat module is fastened to the pool wall approximate the mouth of the chamber, both to stabilize the final position of the installed skimmer and to seal the opening through the pool wall against ingress of water, debris, etc. Typically, a mounting bracket or flange is attached to or integral with the chamber at its mouth, forming a planar attachment surface; or, the chamber wall is sufficiently thick to receive a fastener, and thus forms the planar attachment surface. This attachment surface flushly contacts the exterior surface of the pool wall. A cooperating mounting bracket flushly contacts the interior surface of the pool wall, surrounding the inlet to the chamber. Fasteners can be driven through the mounting bracket and (optionally) pool wall and into the attachment surface of the chamber to secure the throat module to the pool wall. A finishing bracket or facing may be installed over the mounting bracket for aesthetics and increased watertightness.

The typical skimmer described above can achieve its optimal functionality if the pool wall is vertical (i.e., perpendicular to the water surface) at the area where the throat module is coupled to it, but problems arise if the pool wall is sloped (or angled, as used herein)—the flush attachment of the skimmer to an angled pool wall rotates the entire skimmer assembly the same angle away from vertical. This places water levels out of equilibrium—that is, the linear flow of the water is no longer parallel to the top and bottom of the throat module. As a result, the weir, vacuum, return ports, etc., may not operate correctly. Also, the vessel may not properly attach to corresponding components due to misalignments.

Swimming pools made of fiberglass can have walls made at different angles with respect to vertical, depending on the specification for each manufacturer; vinyl and concrete pools can have walls that are angled at the water surface as well. The market for fiberglass pools, which are prefabricated and laid whole into the ground upon installation, are large enough that some skimmer manufacturers have attempted to address the angled-wall problem by designing a throat module that terminates with an angled attachment surface. Of course, the angle is an element of the pool design, and so a given skimmer is only selectable for pools that match its angle. Moreover, the pool wall angle is an artifact of manufacture, construction, and/or installation, and the exact angle may not be known until after the wrong skimmer has been selected and, possibly, installed. A skimmer with a throat module attachment mechanism that is adaptable to the true angle of the pool wall is needed.

SUMMARY

The present disclosure provides devices, methods of making devices, and methods of using devices, for efficiently "skimming" dirt and debris from the water surface in a swimming pool or spa having a pool wall that is angled relative to vertical. In one aspect, the disclosure provides a device including: a first mounting bracket having a face that contacts a wall of the swimming pool or spa, the first mounting bracket being attached to or integral with a hinge and rotatable about an axis of the hinge to provide angular adjustment of the face; a second mounting bracket positioned distally from the first mounting bracket and configured to be installed substantially perpendicular to a water line of the swimming pool or spa, the first mounting bracket rotating relative to the second mounting bracket; an adjustment mechanism mechanically coupled to the first and second mounting brackets and configured to lock the first mounting bracket at a desired angle, relative to a vertical plane parallel to the second mounting bracket, that allows flush contact of the face with the pool wall; and, a flexible shroud made of waterproof material, the shroud attached between the first and second mounting brackets to form a waterproof chamber extending from the face of the first mounting bracket through the shroud and the second mounting bracket.

The second mounting bracket can include one or more notches that receive corresponding tabs of a weir to attach the weir to the device in a position that rotatable occludes the chamber to allow water to flow distally past the weir and substantially prevent water from flowing proximally past the weir. The adjustment mechanism can include an adjustor base attached to or integral with a first side of the second mounting bracket, the adjustor base matedly cooperating with the first mounting bracket to allow the first mounting bracket to rotate and to be locked, using the adjustment mechanism, at the desired angle. The adjustment mechanism can further include a resilient pawl attached to or integral with the adjustor base, the pawl having a first set of teeth; the first mounting bracket can include a body defining the face, and a gear member extending distally from the body into contact with the adjustment mechanism, the gear member including a second set of teeth that interface with the first set of teeth to form a ratcheting mechanism, the first mounting bracket being rotatable through an angular range defined by the second set of teeth. The adjustor base can include a locking bore, and the device can include a locking screw that threads through the locking bore and is tightened into contact with the first mounting bracket to lock the first mounting bracket at the desired angle. The second mounting bracket can include a plurality of slots disposed through the first side; the adjustor base can include a plurality of tabs arranged in alignment with the plurality of slots, and the adjustor base can be secured to the second mounting bracket by friction fit of the plurality of tabs into the plurality of slots.

The first and second mounting brackets can each include a corresponding shroud channel, with the shroud coupled to each of the first and second mounting brackets within the corresponding shroud channels via an overmolding process. The device can further include an upper shroud guard attached to the second mounting bracket and extending over a top of the shroud, the upper shroud guard made of a material that is sufficiently rigid to deflect debris that would damage the shroud during installation of the device. The device can include face plate having a mounting ring that attaches to the first mounting bracket through the wall to securely attach the device to the wall, and a lower shroud guard attached to or integral with the mounting ring and extending distally from the mounting ring into the chamber and over a bottom of the shroud. The device can further include a finishing cover having a finishing ring that attaches to the face plate to conceal the mounting ring, and one or more side shroud guards attached to or integral with the finishing ring and extending distally from the finishing ring into the chamber to cover the shroud.

The device can further include a support plate attached to each of the first and second mounting brackets and supporting the first mounting bracket to maintain the desired angle and the second mounting bracket to maintain a vertical orientation. The support plate can include a mounting groove; the second mounting bracket can include a body and one or more projections extending downward from the body, the one or more projections inserting into the mounting groove to attach the second mounting bracket to the support plate. The support plate can include a first hinge member, and the first mounting bracket can include a second hinge member that cooperates with the first hinge member to form the hinge. The support plate can also include a throat support member that laminates to a throat module of a skimmer to integrate the device with the skimmer.

The device can further include: a vessel including one or more ports configuring the vessel to fluidly connect to a suction side of a cleaning system of the swimming pool or spa; a throat module having a proximal end and a distal end, the throat module attached to or integral with the second mounting bracket at the proximal end, and the throat module attached to or integral with the vessel at the distal end, the throat module extending the chamber into fluid communication with the vessel; and, a weir disposed in the chamber and configured to rotatably occlude the chamber to allow water to flow distally past the weir and to substantially prevent water from flowing proximally past the weir.

In another aspect, the disclosure provides a method of installing a skimmer for a swimming pool or spa. An installer positions, adjacent to an exterior surface of a wall of the swimming pool or spa and approximate an aperture through the wall for mounting the skimmer, an embodiment of the present interface module. The interface module includes: a first mounting bracket including a planar face on its proximal side, the first mounting bracket being rotatable about an axis to provide angular adjustment of the face, wherein positioning the interface module comprises orienting the face toward the wall; a second mounting bracket positioned distally from the first mounting bracket, the first mounting bracket rotating relative to the second mounting bracket; a flexible shroud made of waterproof material, the shroud attached between the first and second mounting brackets to form a waterproof chamber through the interface module, the shroud sufficiently expanding and contracting as the first mounting bracket is rotated to keep the chamber waterproof; and, an adjustment mechanism mechanically coupled to the first and second mounting brackets to releasably lock rotation of the first mounting bracket. The installer actuates the adjustment mechanism to release the first mounting bracket into rotation. The installer rotates the first mounting bracket to a desired angle, relative to the second mounting bracket, that allows substantially flush contact of the face with the exterior surface of the wall around a perimeter of the aperture through the wall. The installer actuates the adjustment mechanism to lock the first mounting bracket at the desired angle. The installer secures the interface module to the wall of the swimming pool with the face in contact with the exterior surface around the aperture and the second mounting bracket substantially perpendicular to a water line of the swimming pool or spa.

The actuating mechanism can include a base, a resilient pawl attached to or integral with the base, and a thumb-operable actuator attached to or integral with the pawl, and the first mounting bracket can include a body defining the face, and a gear member extending distally from the body into mechanical communication with the actuating mechanism, the gear member cooperating with the pawl to form a ratcheting mechanism; actuating the adjustment mechanism to release the first mounting bracket into rotation can include applying force to the actuator to lift the pawl away from the gear member. The adjustment mechanism can further include a bore and a screw threaded with the bore, and actuating the adjustment mechanism to lock the first mounting bracket at the desired angle can include removing the force from the actuator so the pawl re-engages the gear member with the first mounting bracket rotated to the desired angle, and tightening the screw through the bore into contact with the first mounting bracket.

In the method, the installer can further laminate the second mounting bracket to a throat module of the skimmer to extend the chamber distally through the throat module to a vessel of the skimmer. The interface module can further include a support plate including an assembly support member, a first hinge member extending proximally from the assembly support member, and a throat support member extending distally from the assembly support member; with the first mounting bracket including a body defining the face, and a second hinge member extending downward from a bottom of the body and cooperating with the first hinge member to form a hinge at the axis of rotation of the first mounting bracket, and with the second mounting bracket attached to the assembly support member to position the second mounting bracket parallel to the vertical plane, the installer can further laminate the throat module to the support member.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION

This invention is described in preferred embodiments in the following description with reference to the Figures, in which like numbers represent similar but not necessarily identical elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

This disclosure presents structural designs, methods of manufacture, and methods of installation, for a device for cleaning swimming pools and spas, known as a skimmer, with an adjustable pool-side mounting assembly that rotates through a range of angles so the assembly can be mounted flush against the pool wall even when the angle of the pool wall is unknown before installation. This disclosure provides embodiments of a skimmer having a vessel and a throat module including the mounting assembly, as well as a mounting assembly that can be installed onto the throat module in an existing skimmer to render the skimmer adjustable. At installation, the proper angle with respect to the pool wall is determined and then the mounting assembly is adjusted appropriately, and the skimmer is installed in a hole next to the pool, with the vessel substantially vertical and the mounting assembly flush against the pool wall. The example embodiment of the Figures is especially fit for use with fiberglass swimming pools and spas as explained below, but in various embodiments the invention is suitable for in-ground pools and spas of concrete or any other commonly-used materials.

Figure 1A:
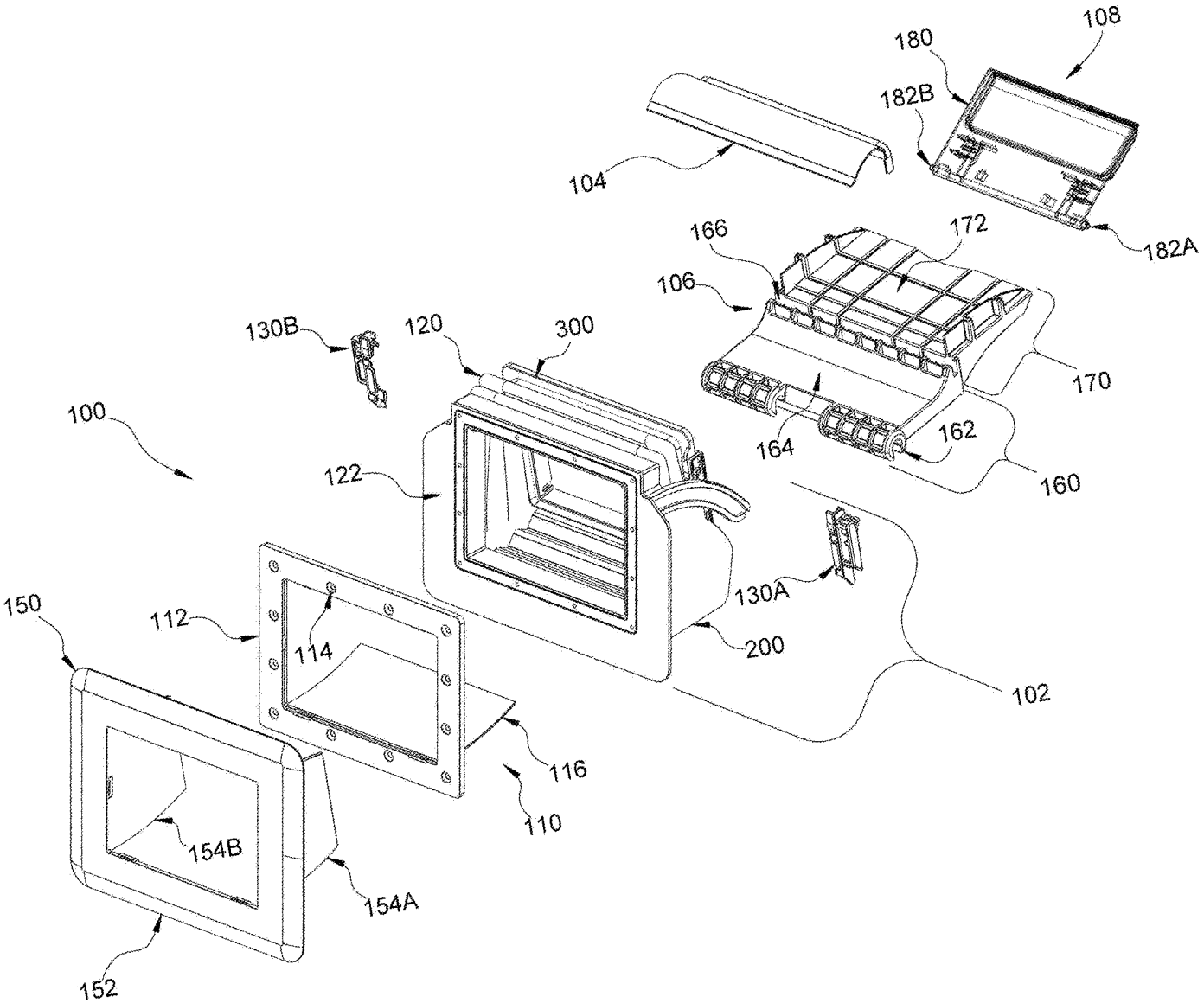
FIG. 1A is a top-front-right perspective exploded view of an example embodiment of an adjustable-face skimmer interface module, in accordance with the present disclosure.
Figure 1B:
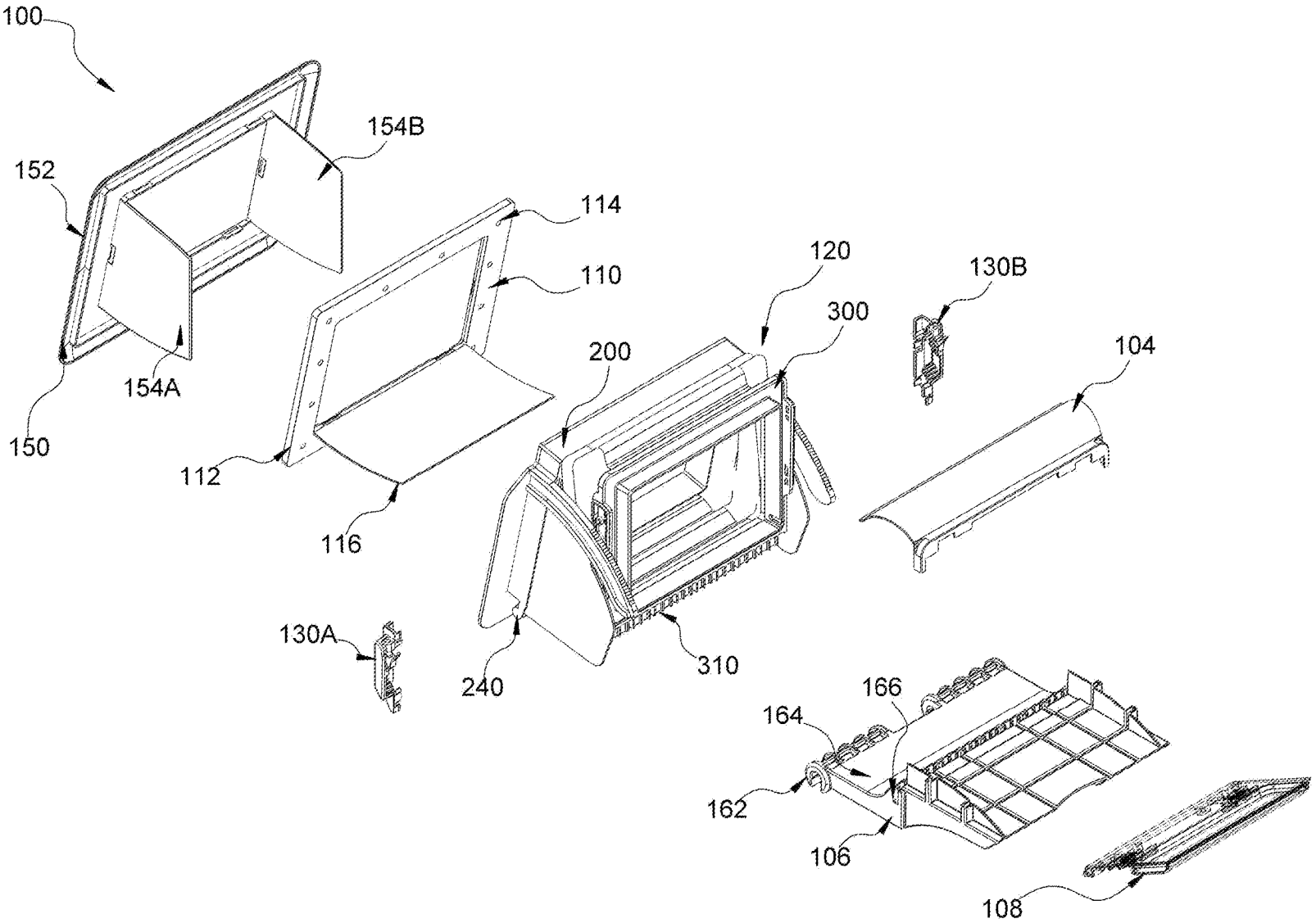
FIG. 1B is a top-rear-right perspective exploded view of the example interface module of FIG. 1A.

Referring to FIGS. 1A and 1B, an example embodiment of an interface module 100 is shown in exploded perspective. Generally, the interface module 100 may attach to or be integral with a throat module of an in-ground pool/spa skimmer; the interface module 100 serves to define the interface of the skimmer with the pool or spa, including a mouth of a flow chamber and the flush mounting of the skimmer face with the pool wall ("flush" meaning that the planes of the mounting surfaces are substantially parallel (i.e, within one degree of parallel) to the plane of the pool wall surface), so that the throat module is parallel to the water line in the pool/spa even if the pool wall is angled (i.e., the plane of the pool wall interior surface is not orthogonal to the plane of the water level, at the location of the skimmer mouth).

In some embodiments, including the illustrated example, the interface module 100 can include an adjustable face assembly 102 described in detail below. In some embodiments, the assembly 102 can include a first mounting bracket 200 having, at its distal end, one or more surfaces that together define the plane within which the mounting bracket 200 makes flush contact with the exterior surface of the pool wall. This plane of contact surfaces is the adjustable "face" 122 of the assembly 102. The assembly 102 can further include a second mounting bracket 300 positioned proximal to (i.e., toward the skimmer from) the first mounting bracket 200. The second mounting bracket 300 interfaces orthogonally with the throat module, and can be laminated to the throat module at manufacture or during installation of the assembly 102. A compressible shroud 120 can be coupled between the mounting brackets 200, 300. The shroud 120 may be an elastomer membrane or another suitable flexible, waterproof material. In some embodiments, the shroud 120 can be attached between the two rigid plastic brackets via injection over-molding; the over-molded pieces are fused into a single unit during the injection molding process, which creates a permanent waterproof seal between the three components (two rigid & one flexible).

The assembly 102 cooperates with a lower support plate 106 to provide an angle adjustment mechanism: the lower support plate 106 attaches to (or is integral with) the second mounting bracket 300, and supports the second mounting bracket 300 substantially perpendicular to the water line; the lower support plate 106 rotatably attaches to the first mounting bracket 200 (e.g. at a hinge formed by first and second hinge members 162, 240); the shroud 120 flexes to allow the angular rotation of the first mounting bracket 200 proximally-to-distally around the hinge; and, right and left adjustors 130A, 103B attach to the right and left sides, respectively, of the assembly 102 between the mounting brackets 200, 300 to form a ratcheting mechanism for setting and locking the desired angle of the adjustable face. The face 122, in the present example, has a 20-degree range of articulation, in one-degree increments; in particular, the face 122 is capable of rotating 8 degrees forward (i.e., distally, toward the pool) from vertical (i.e., perpendicular to the water line), and 12 degrees back (i.e., proximally, toward the skimmer) from vertical. Other ranges of articulation are contemplated, as needed to meet the needs of the market, should they change in the future.

The flexible membrane of the shroud 120 has the potential to puncture from construction materials (i.e., sharp rocks, nails, staples, etc.) during the installation process. An upper shroud guard 104, a thin rigid plastic shield, may be permanently or removably attached to the second mounting bracket 300 and disposed over the top surface of the shroud 120 during installation or permanently. In some embodiments, the upper shroud guard 104 can be a thin rigid plastic shield, covering 85% or more of the outside portions of the flexible membrane to eliminate potential hazards. The shroud guard 104 can be capable of adjusting while the desired angle is being set to protect any exposed portion of the flexible membrane.

The lower support plate 106 can be partitioned into a distal section that serves as an assembly support member 160, and a proximal section that serves as a throat support member 170. The assembly support member 160 includes one or more hinge sleeves 162 that receive the second hinge member 240 (i.e., the shaft or post) of the first mounting bracket 200 to create the rotatable attachment. The assembly support member 160 may further include an assembly support surface 164 extending proximally from the hinge sleeve 162 and positioned beneath the shroud 120 to further protect it. The assembly support member 160 can further include a mounting groove 166 that receives mated projections 310 of the second mounting bracket 300 to couple the second mounting bracket 300 to the lower support plate 106, vertically within the groove 166. The throat support member 170 can be laminated (i.e., at the throat support surface 172) to the skimmer throat to create a permanent, rigid bridge between the two rigid brackets that flank the flexible membrane, while offering a solid support structure to mount to the skimmer body.

A weir 108, which may have any common design for a skimmer weir, can be attached to the assembly 102 (e.g., at the second mounting bracket 300 as described below) to interrupt the flow of water through the assembly 102 and into the skimmer vessel. In one example, the weir 108 is rotatably attached at right and left tabs 182A,B to the assembly 102 so that the body 180 of the weir 108 rotates around an axis to vary occlusion of the flow chamber.

A face plate 110 of the interface module 100 can include a planar mounting bracket 112 with fastener holes 114 disposed therethrough. The face plate 110 may further include a lower shroud guard 116 extending proximally from a lower lip of the bracket 112. The face plate 110 is installed flush against the interior surface of the pool wall, encircling the opening through the pool wall. To mount the interface module 100, fasteners (not shown) are driven through the fastener holes 114 into the body of the first mounting bracket 200, as described further below. This disposes the lower shroud guard 116 within the interior space of the assembly 102, substantially or fully over the bottom surface of the shroud 120. A finishing cover 150 can then be installed over the face plate 110, for aesthetic reasons as well as to protect the face plate 110 and assembly 102. In an example embodiment, the cover 150 includes a finishing ring 152 and right and left side shroud guards 154A,B that project proximally from the finishing ring 152; when the cover 150 is installed, the finishing ring 152 covers the mounting bracket 112, and the side shroud guards 154A,B extend into the flow chamber and cover the shroud 120. The finishing ring 152 and the mounting bracket 112 can have cooperating resilient tabs or projections that allow the finishing ring 152 to be snapped in place over the face plate 110.

Figure 2A:
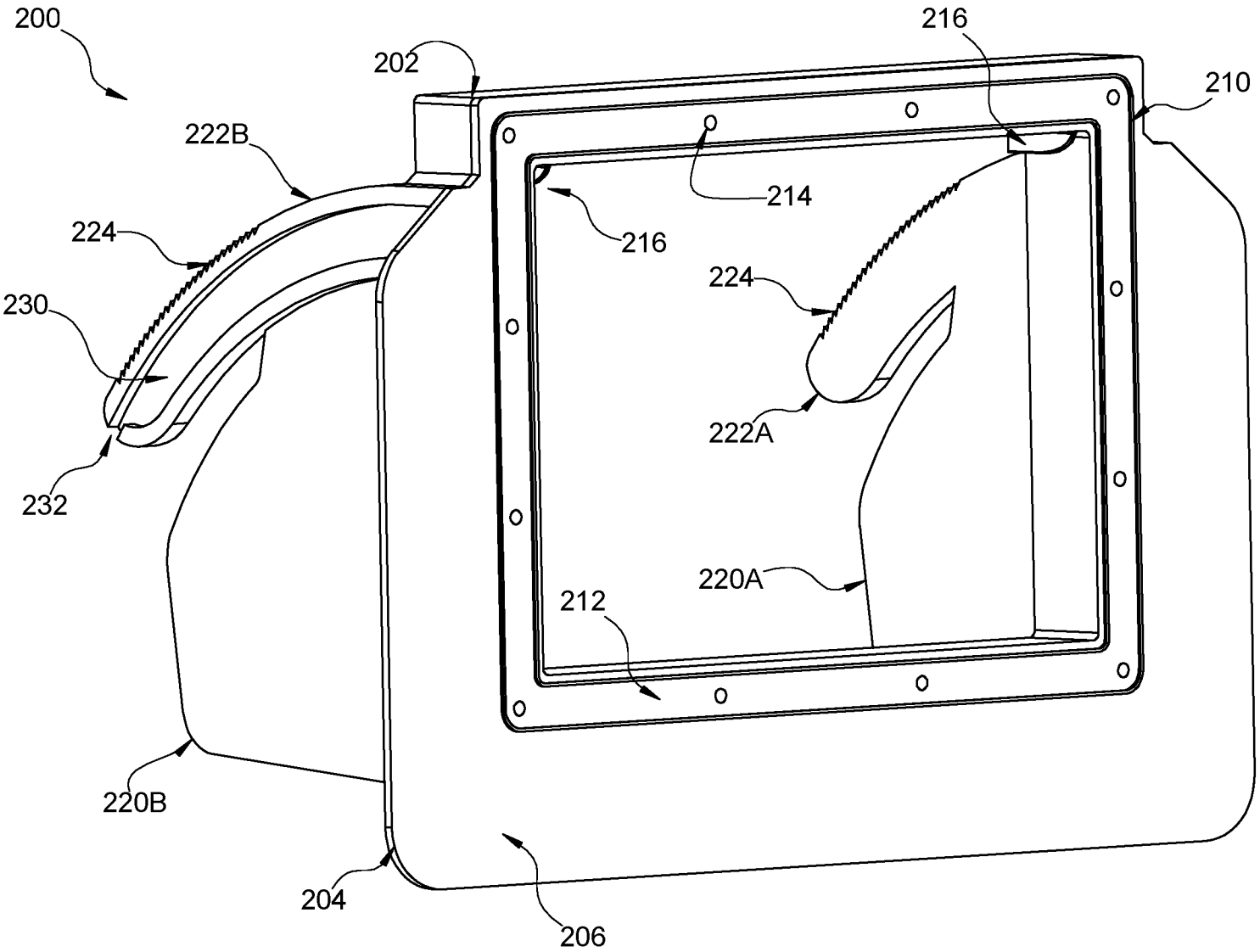
FIG. 2A is a top-front-left perspective view of a pool-side mounting bracket of an example adjustable face assembly.
Figure 2B:
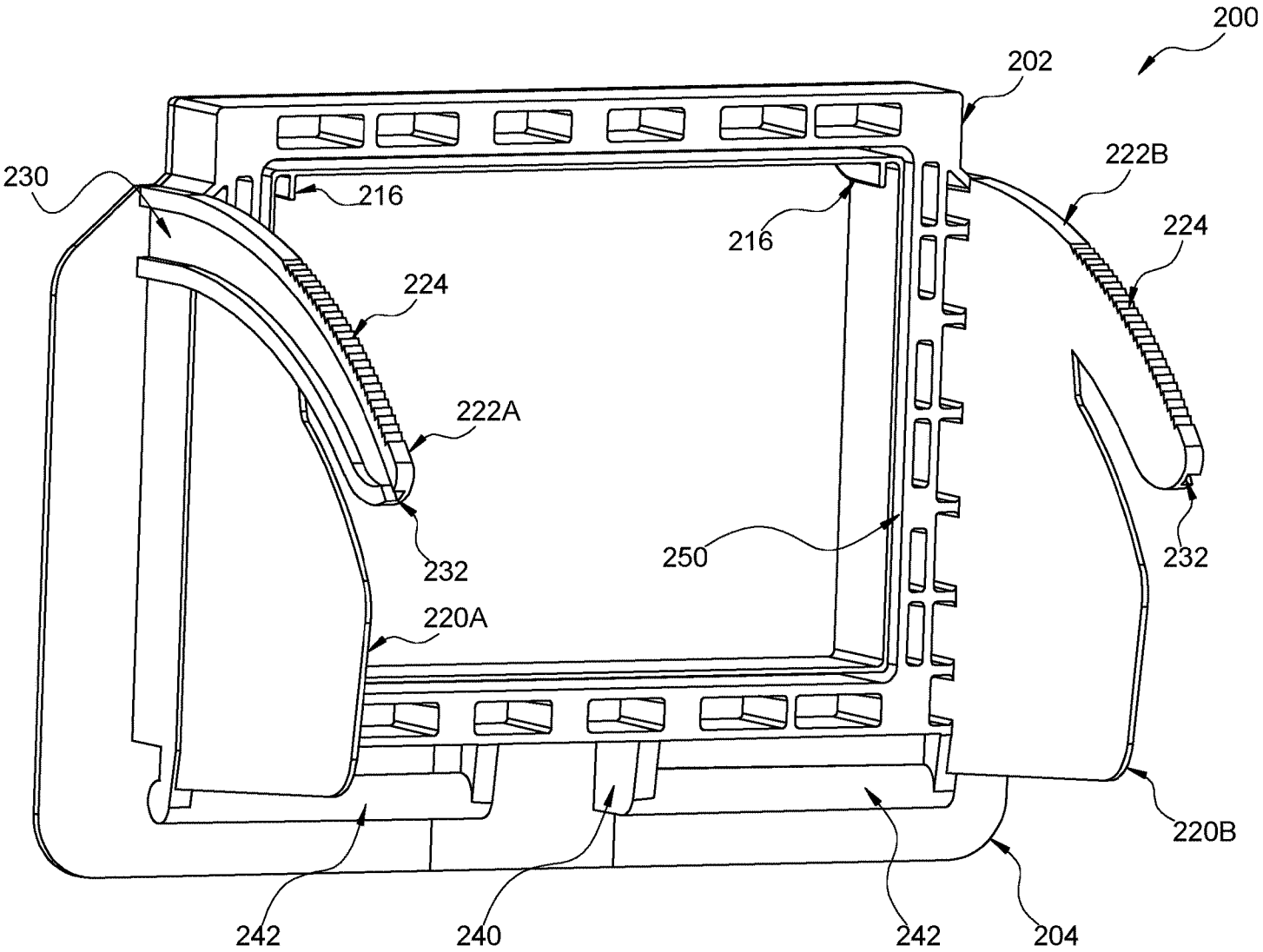
FIG. 2B is a rear-right perspective view of the mounting bracket of FIG. 2A.
Figure 2C:
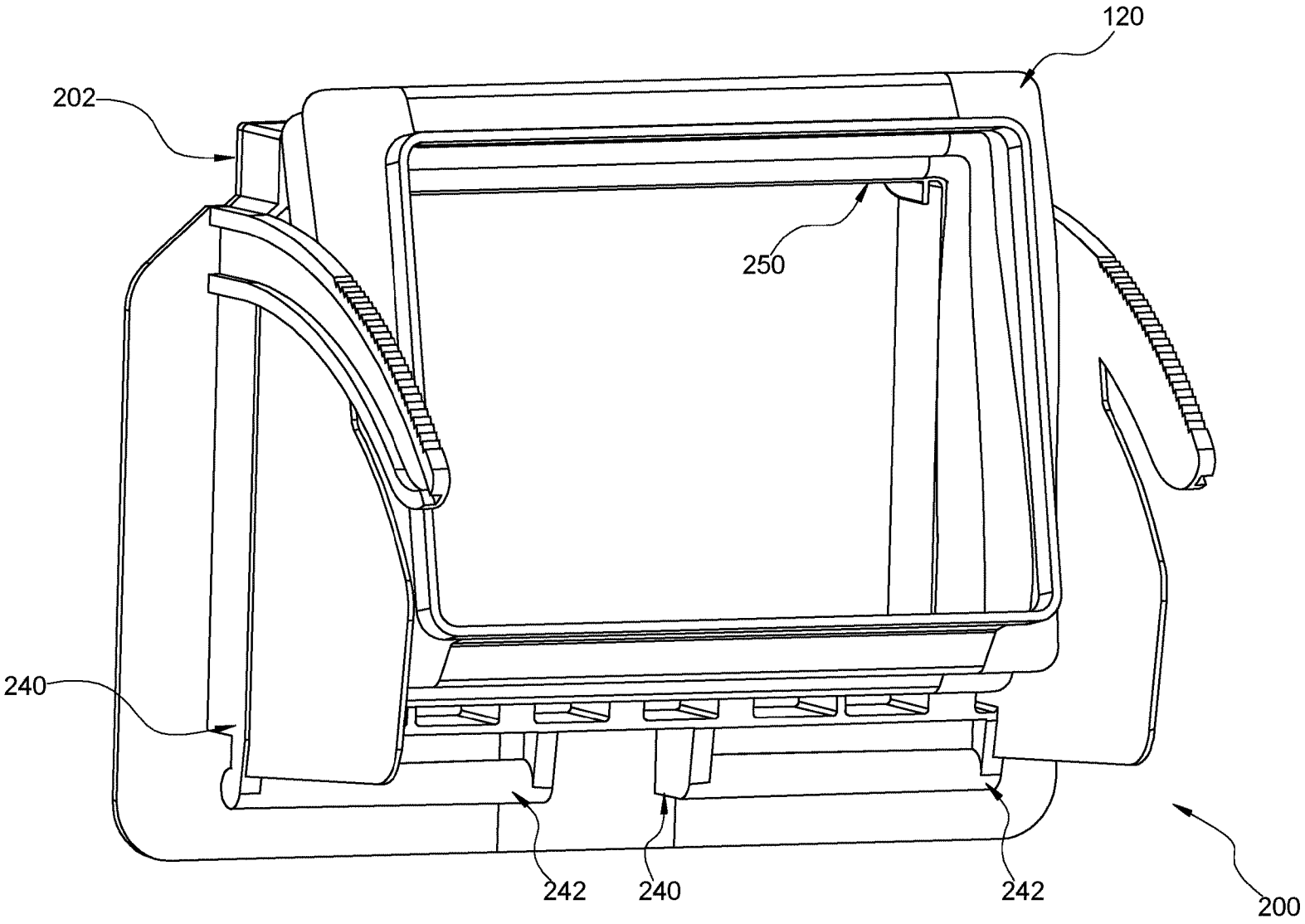
FIG. 2C is a rear-right perspective view of the mounting bracket of FIG. 2A with a compressible shroud coupled thereto, in accordance with embodiments of the present disclosure.

FIGS. 2A and 2B depict an example embodiment of the first mounting bracket 200 of FIGS. 1A-B, and FIG. 2C depicts the example first mounting bracket 200 coupled to a shroud 120 as described above. A body 202 provides the structural foundation of the bracket 200, and has a front that defines the mouth 201 of the flow chamber. A flange 204 extending laterally from the distal end of the body 202 may define a flange surface 206 that can serve as an attachment/contact surface; additionally or alternatively, the flange 204 can provide additional structural support to the bracket 200. In some embodiments, a raised or proud contact ring 210 may extend from the flange surface 206, and can have a perimeter that is either slightly larger or slightly smaller than the opening in the pool wall. The contact ring 210 defines an attachment surface 212 that contacts the exterior surface of the pool wall when the contact ring 210 is larger than the opening in the pool wall. A series of pre-tapped holes 214 can be disposed around the contact ring 210, through the attachment surface 212. In some embodiments, the pattern of these holes 214 aligns with the pattern of fastener holes 114 in the face plate 110 of FIGS. 1A-B, and receive the fasteners used to attach the face plate 110 to the assembly 102. Tabs 216 extend downward from a top of the opening in the body 202—these serve to guide the side shroud guards 154A,B (of cover 150 of FIG. 1A) into proper position inside the flow chamber.

The first mounting bracket 200 may include right and left wings 220A,B that extend proximally from the body 202. The wings 220A,B provide structural support, protect the outer surfaces of the shroud 120, and support elements of the ratcheting mechanism—specifically, gear members 222A,B. The gear members 222A,B may be arcuate members extending proximally and curving downward, and defining ratchet components including teeth 224, a guide channel 230, and a notch 232, which cooperate with elements of the adjustors 130A,B to form the ratcheting mechanism, as described further below.

The second hinge member 240 may be attached to or integral with the first mounting bracket 200. In some embodiments, the first hinge member 240 comprises one or more shafts 242 that are received by the first hinge member on the lower support plate 106, as described above. Thus, the first mounting bracket 200 rotates around the axis of the shaft(s) 242. A shroud channel 150 formed into the body 202 may serve as the attachment location of the shroud 120, as shown in FIG. 2C.

Figure 3A:
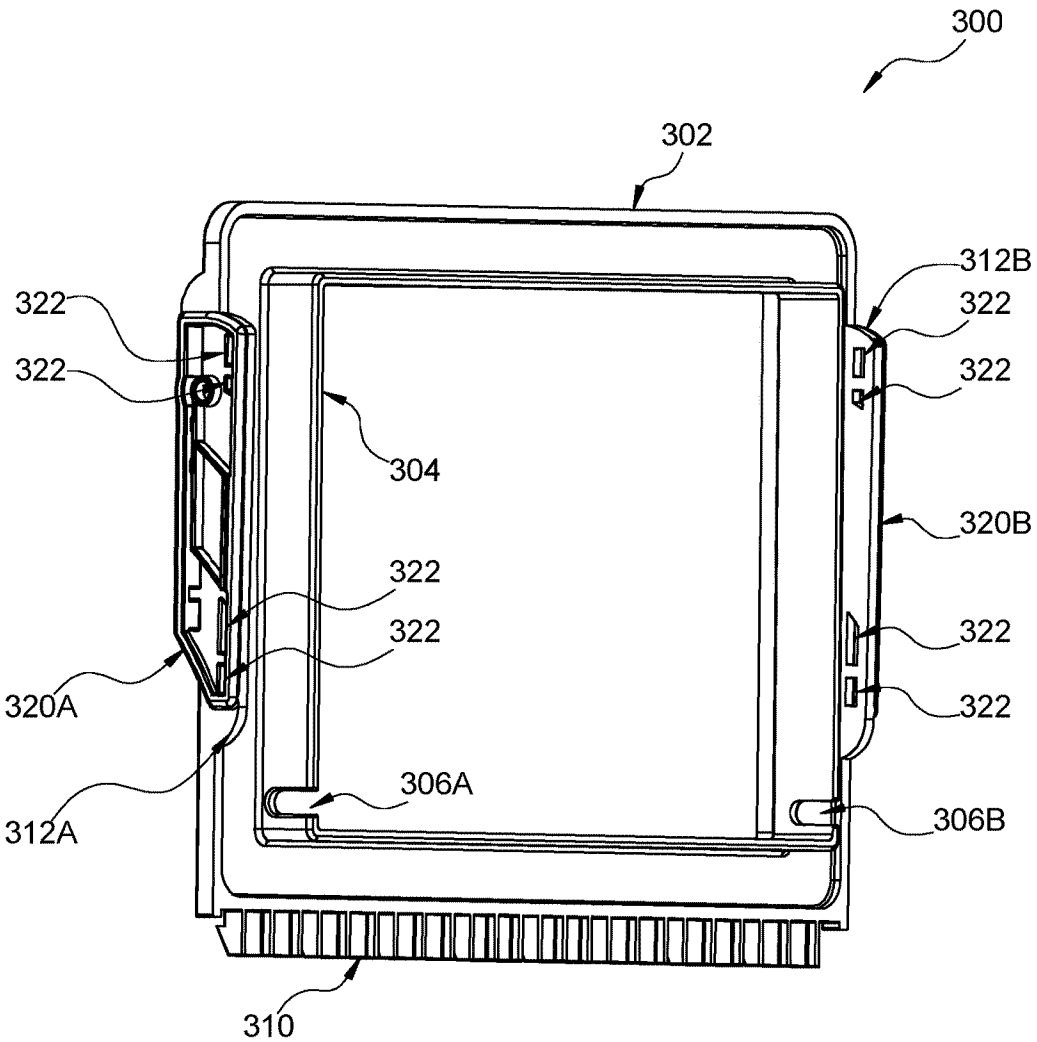
FIG. 3A is a bottom-rear-right perspective view of a throat mounting bracket of an example adjustable face assembly.
Figure 3B:
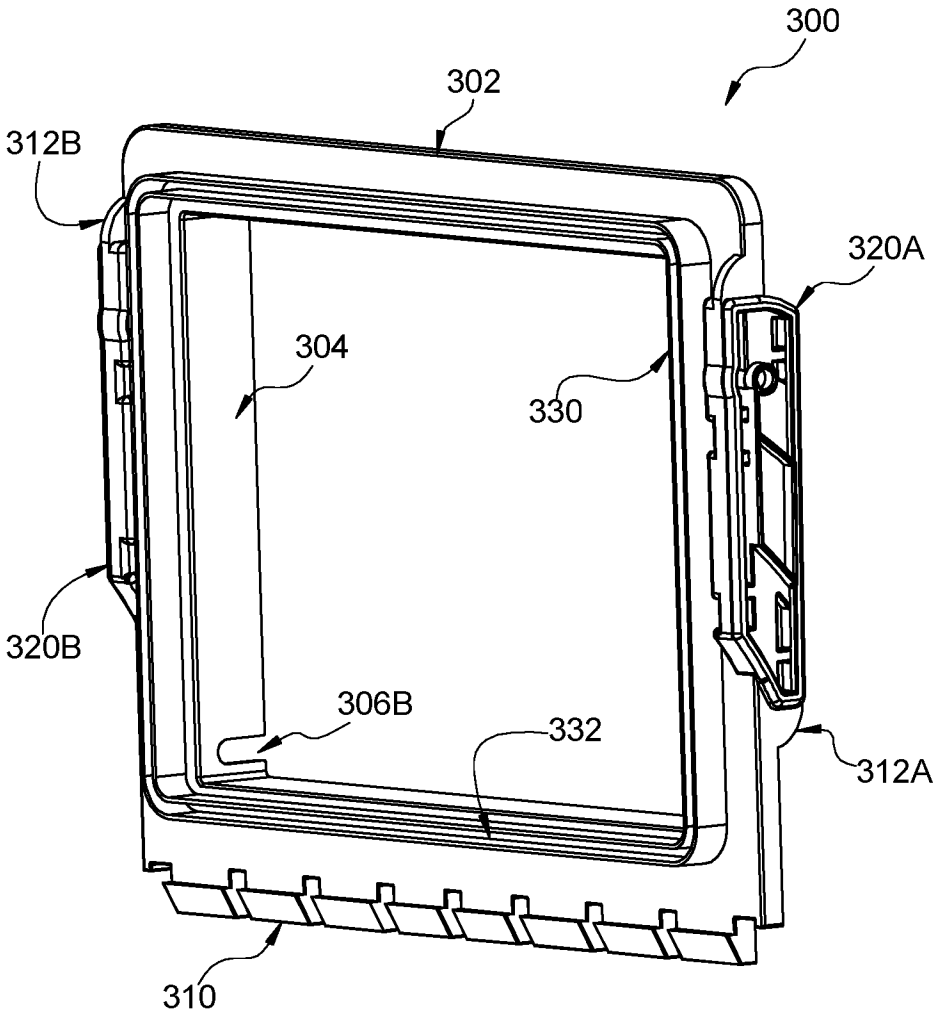
FIG. 3B is a front-right perspective view of the mounting bracket of FIG. 3A.

FIGS. 3A and 3B depict an example embodiment of the second mounting bracket 300 of FIGS. 1A-B, and FIG. 2C depicts the example second mounting bracket 300 coupled to a shroud 120 as described above. A body 302 provides the structural foundation of the bracket 300, and the other elements of the bracket 300 project from the body 302. A frame 304 extends proximally from the body 302, encircling the flow chamber. One or more notches 306A,B may be recessed into the frame 304 to receive the attachment posts of the weir, as described above. One or more latch projections 310 may extend from the bottom of the body 302; these projections 310 are inserted into the lower support plate 106 as described above, and may include hooking or snapping portions that act to securely attach the bracket 300 to the lower support plate 106.

Figure 3C:
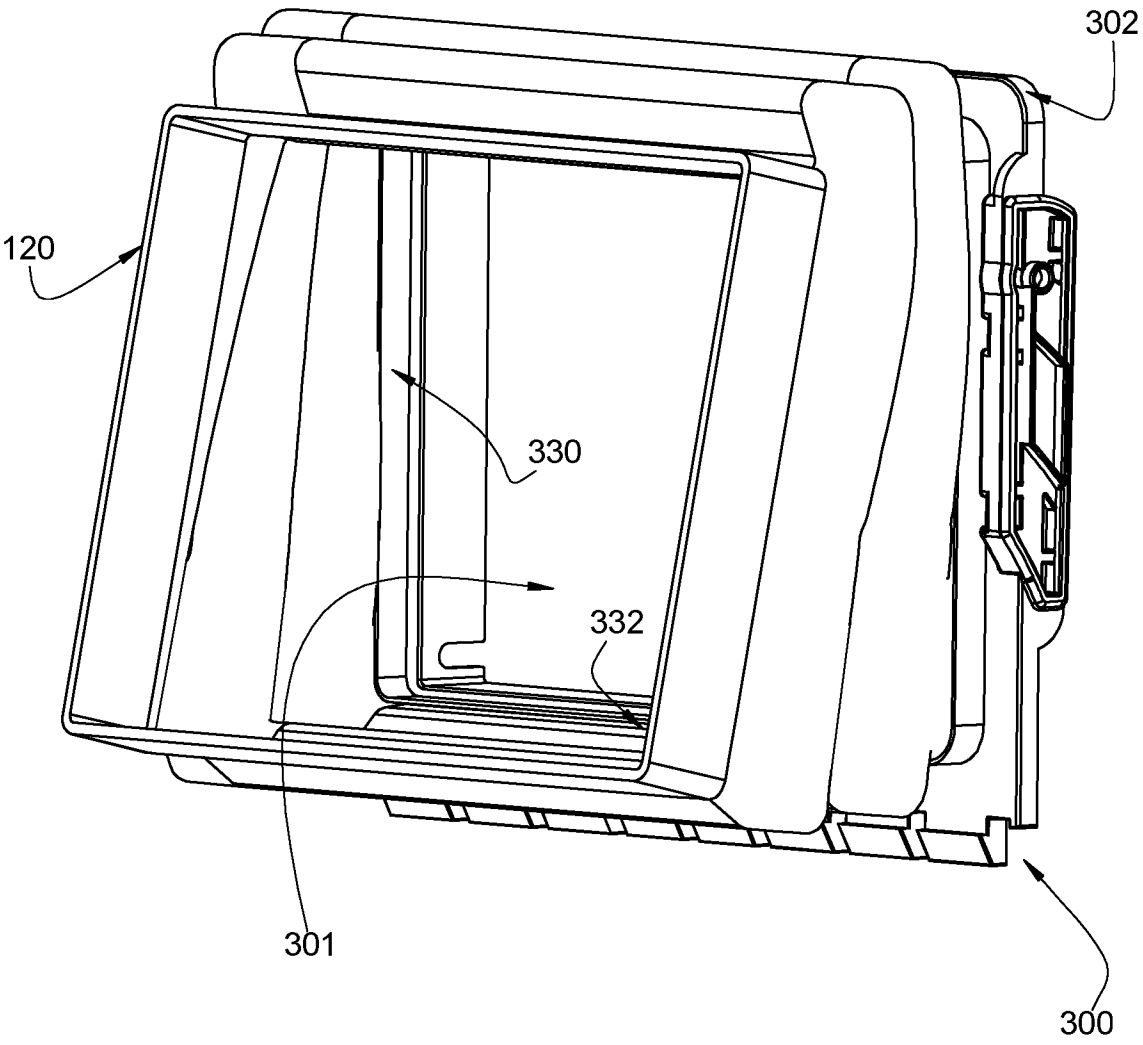
FIG. 3C is a front-right perspective view of the mounting bracket of FIG. 3A with a compressible shroud coupled thereto, in accordance with embodiments of the present disclosure.

Right and left wings 312A,B of the bracket 300 extend proximally and/or distally from the body 302, providing a support surface for right and left receptacles 320A,B configured to receive the corresponding adjustors 130A,B. A receptacle 320A can, in some embodiments, conform to the shape of the corresponding adjustor 130A, as illustrated. Furthermore, the receptacle 320A can include one or more slots 322 disposed through the base 320A and the wing 312A, and configured to securely receive a corresponding tab on the adjustor 320A to hold the latter in place. An overmolding projection 330 extends distally from the body 302, and defines a shroud channel 332 that may serve as the attachment location of the shroud 120, as shown in FIG. 3C with the flow direction 301 through the chamber labeled.

Figure 4B:
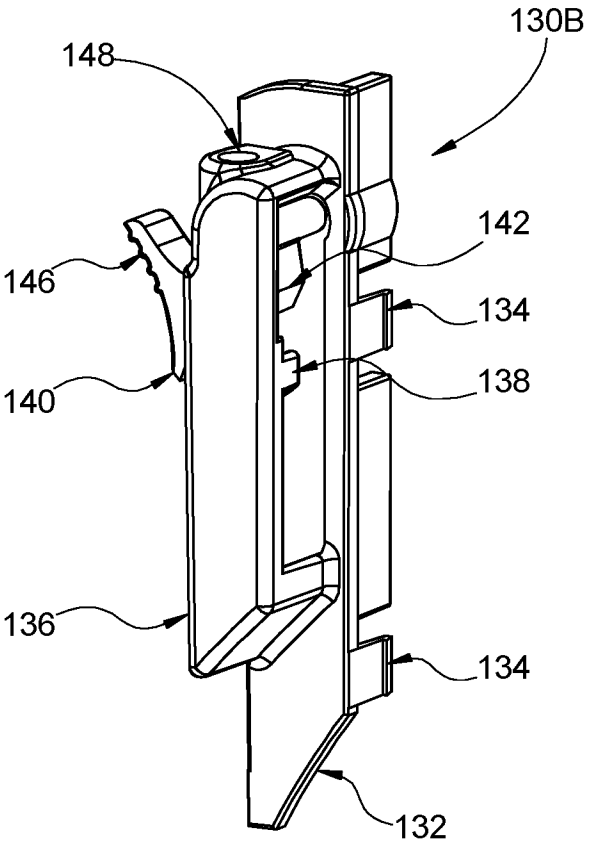
FIGS. 4A and 4B are perspective views of, respectively, right and left adjustors of an example adjustable face assembly.
Figure 4A:
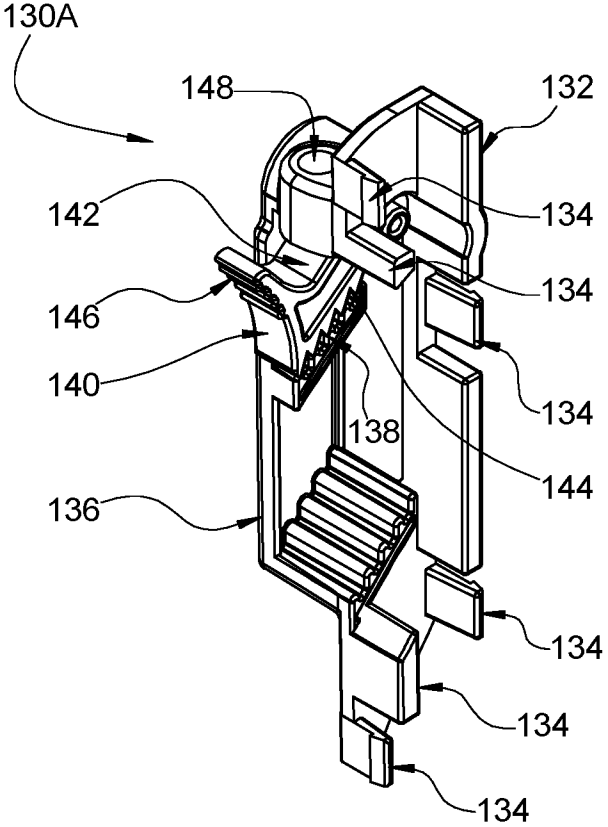

Generally, the adjustors 130A-B cooperate with the brackets 200, 300 (specifically, the gear members 222A,B and the receptacles 320A,B) to create a ratcheting mechanism incorporated into each of the two vertical sides of the adjustable face assembly 102. This provides upper support to counter the weight of the skimmer body, as well as axial hinge balance and even weight distribution between the sides of the skimmer. FIGS. 4A and 4B illustrate, respectively, an example embodiment of a right adjustor 130A and a left adjustor 130B. A adjustor base 132 is the primary structural support, and is inserted into the corresponding receptacle 320A,B. In some embodiments, the adjustor base 132 defines a plurality of locking tabs 134 that align with slots 322, extending through the slots 322 to lock the adjustor 130A,B in place.

Figure 5:
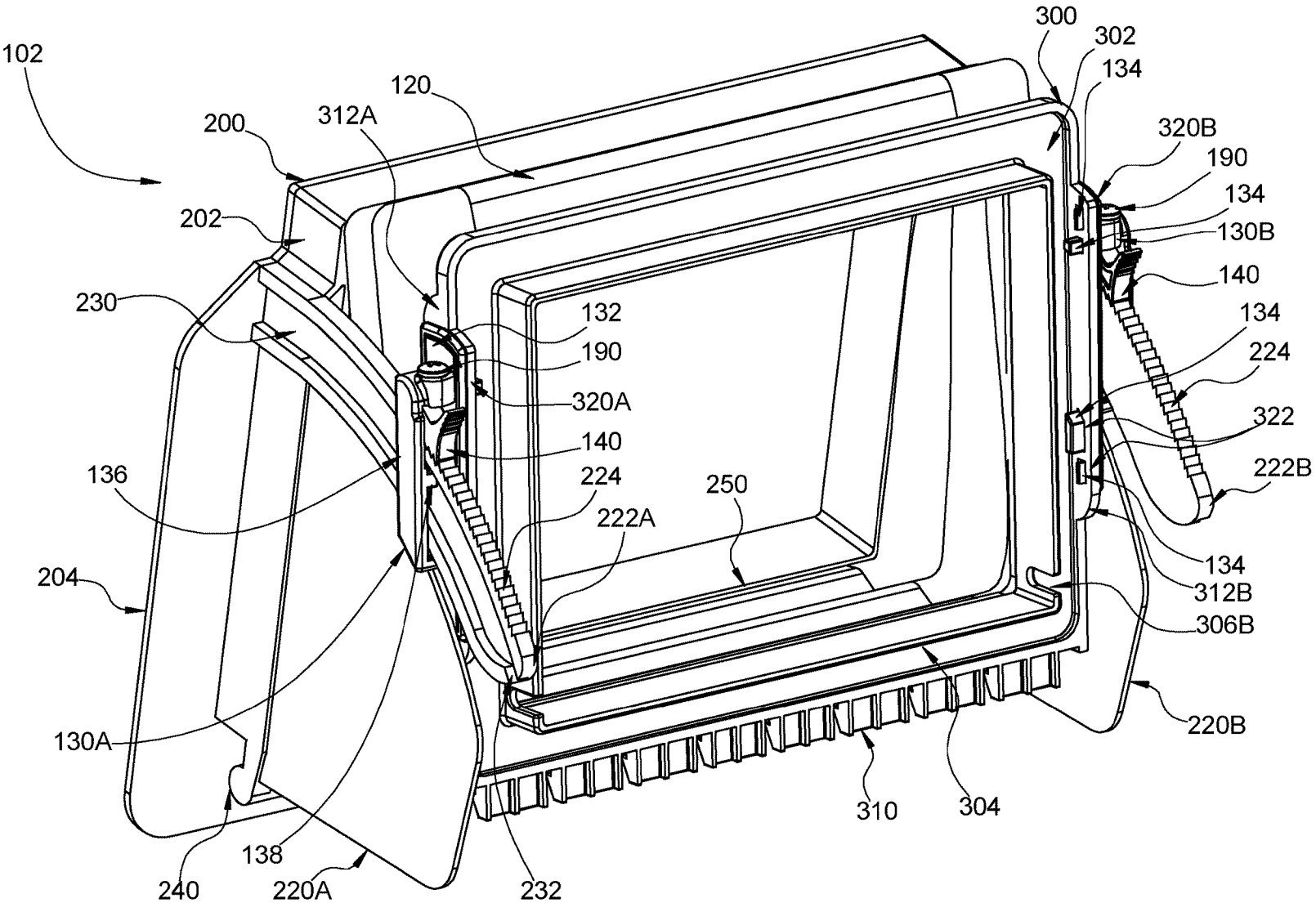
FIG. 5 is a top-rear-right perspective view of an example adjustable face assembly with the adjustment mechanism locking the face in position at a maximum angle offset from vertical, in accordance with the present disclosure.

The adjustor base 132 includes or is integral with a gear sleeve 136, which receives the corresponding gear member 222A,B as illustrated in FIG. 5 and explained further below. A guide member 138 extends into the receiving space within the gear sleeve 136. The guide member 138 extends into the guide channel 230 on the corresponding gear member 222A, B; when the ratcheting mechanism is set and then locked in position, the guide member 138 presses against an inner surface of the guide channel 230 to hold the selected position; the guide member 138 may have a notched or textured surface to increase the coefficient of friction against the guide channel 230. A resilient adjustment mechanism 140 is integral with the gear sleeve 136, and positioned to contact the outer surface of the gear member 222A,B. The adjustment mechanism 140 includes a pawl 142 of the ratchet, teeth 144 that engage the teeth 224 of the gear member 222A,B, and an actuator 146 that is operable by thumb or finger to bias the teeth 144 away from the teeth 224 of the gear member 222A,B. A locking bore 148 receives a lock screw or similar fastener, as described further below.

FIG. 5 depicts the assembly 102 fully assembled, with adjustors 130A,B engaged and locked. In an embodiment, the guide member 138 of each of the adjustors 130A,B is slid through the notch 232 and into the guide channel 230 of the corresponding gear member 222A,B The normal operating position of the ratcheting mechanisms only allow for movement in a single direction (forward, towards the pool wall). This prevents the full weight of the skimmer body from altering the adjustment made by the installer during the installation process. However, the installer can manually press on the two actuators 146, which will lift the ratcheting teeth away and disengage them from the mechanism, allowing the installer to move the position in the opposite direction (backward, away from the pool wall), while the tabs are lifted. Once the adjustment tabs are released, they will automatically fall back into their normal operating position and engage the ratcheting mechanisms. The ratcheting mechanisms are equipped with set screws 190 that allow the installer to tighten and lock the skimmer angle into its set position. This lockable function will prevent movement during the remainder of the installation process.

Figure 6:
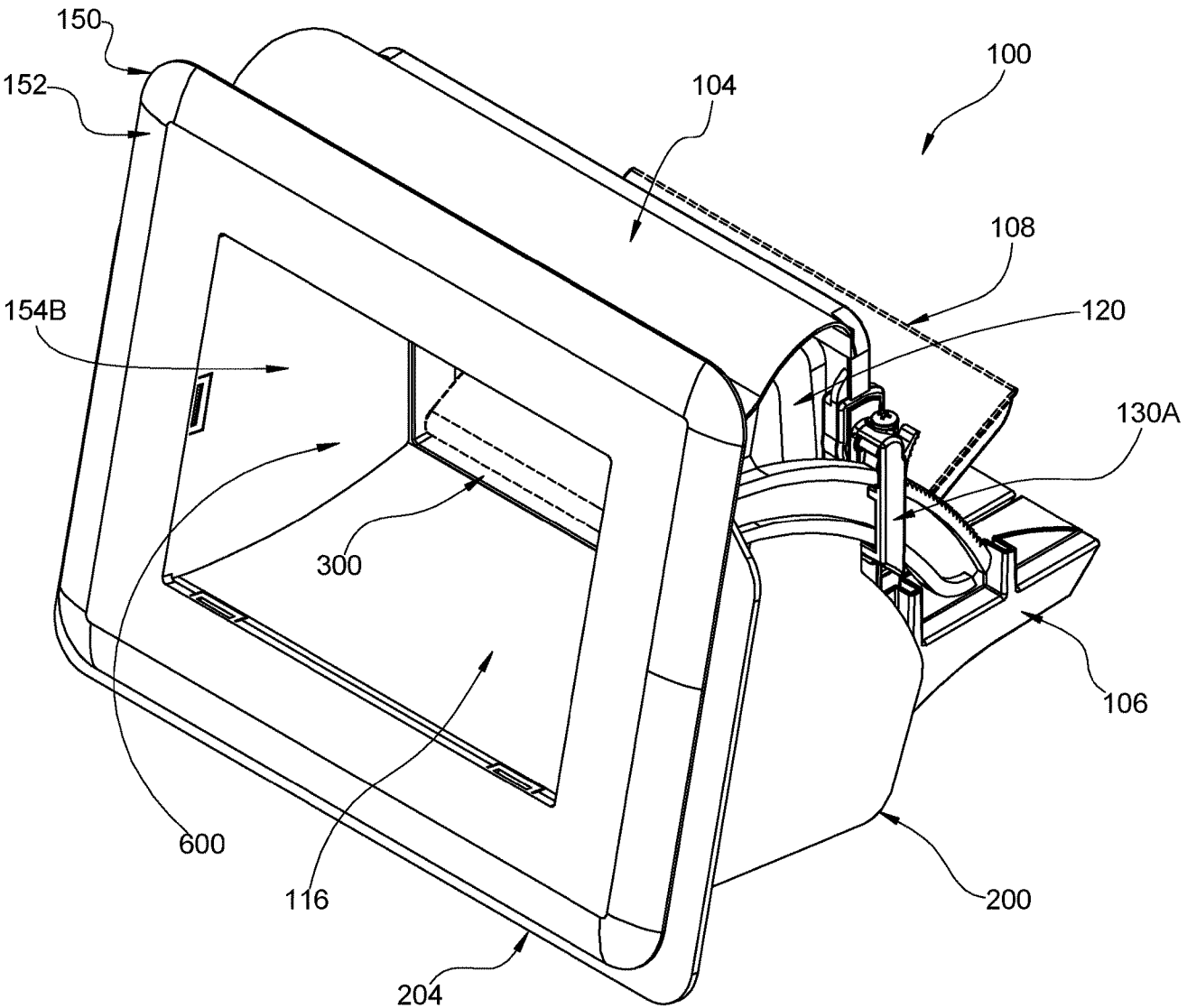
FIG. 6 is a top-front-right perspective view of the example adjustable-face skimmer interface module of FIG. 1A.
Figure 7:
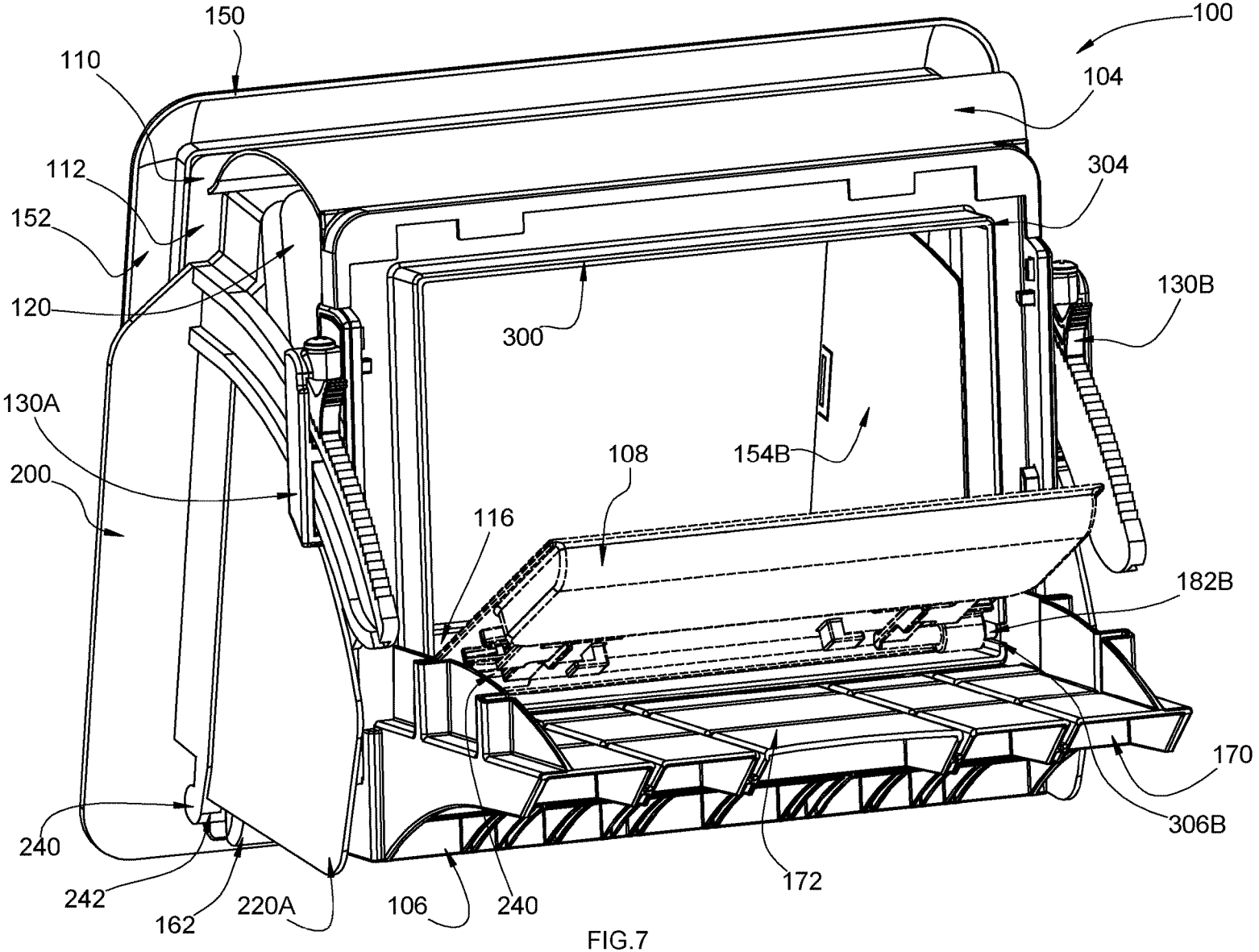
FIG. 7 is a rear-right perspective view of the example adjustable-face skimmer interface module of FIG. 1A.
Figure 8:
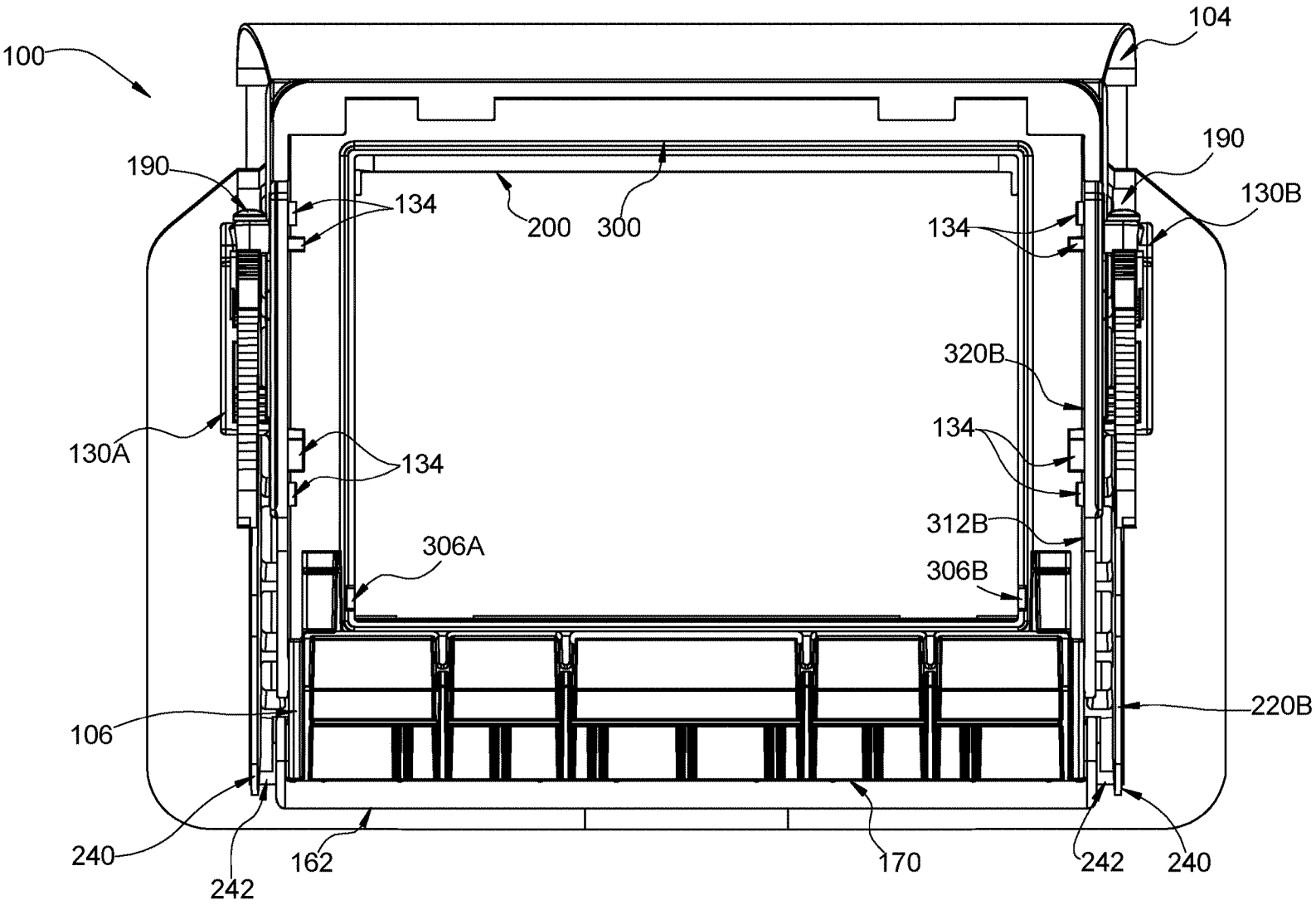
FIG. 8 is a rear view of the example adjustable-face skimmer interface module of FIG. 1A, with the weir and cover removed.
Figure 9:
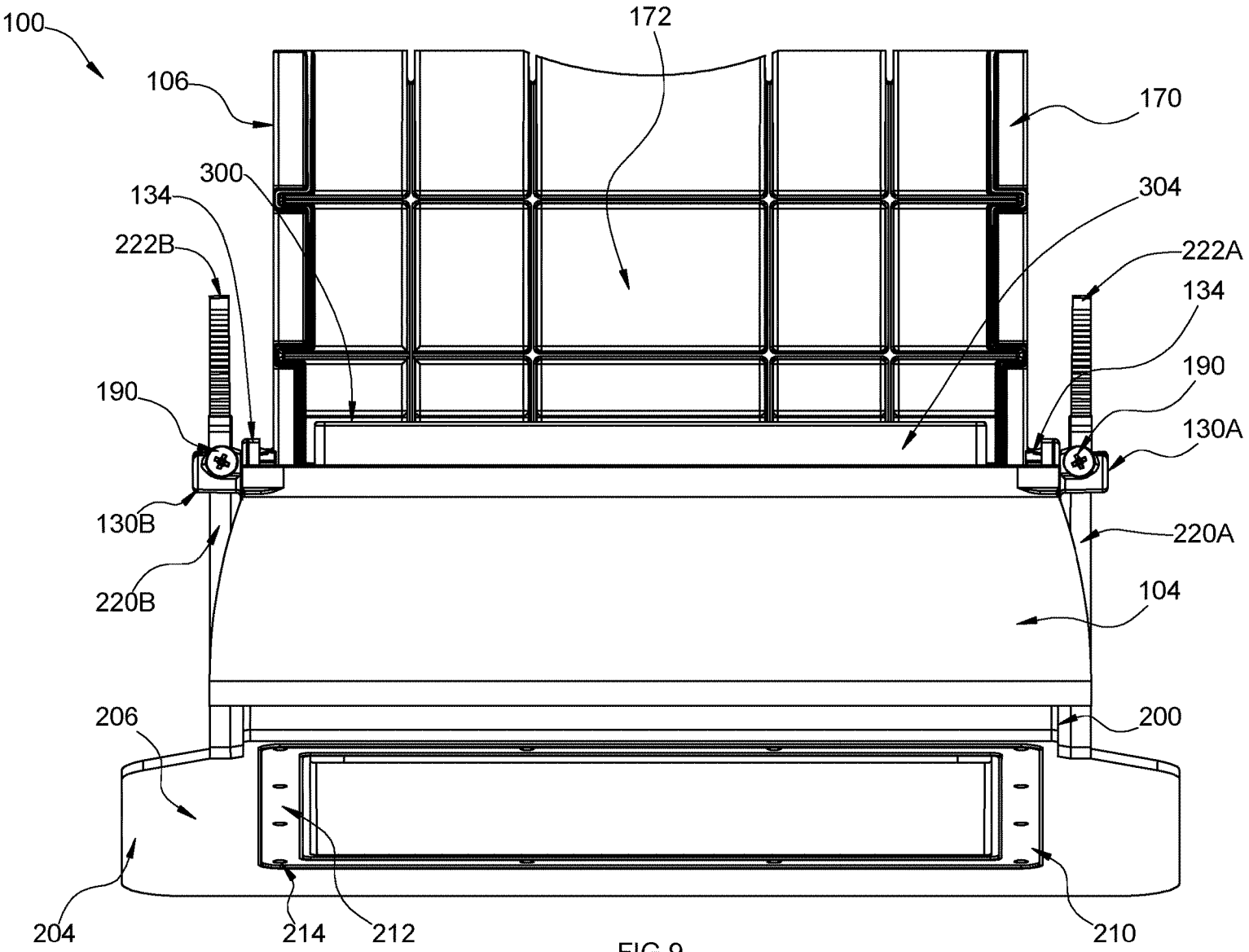
FIG. 9 is a top view of the example adjustable-face skimmer interface module of FIG. 1A, with the face plate and finishing ring removed.
Figure 10:
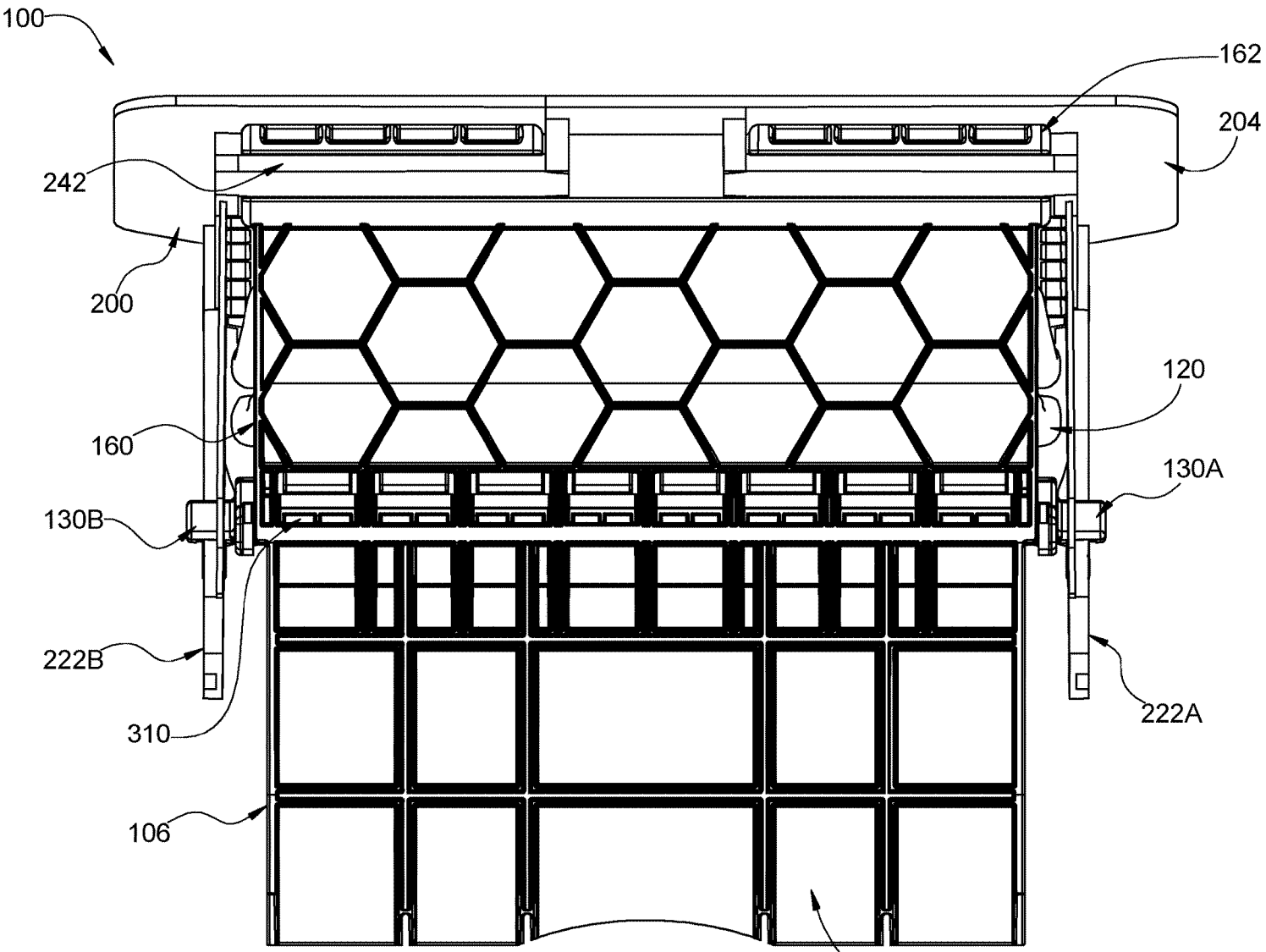
FIG. 10 is a bottom view of the example adjustable-face skimmer interface module of FIG. 1A, with the face plate and finishing ring removed.
Figure 11:
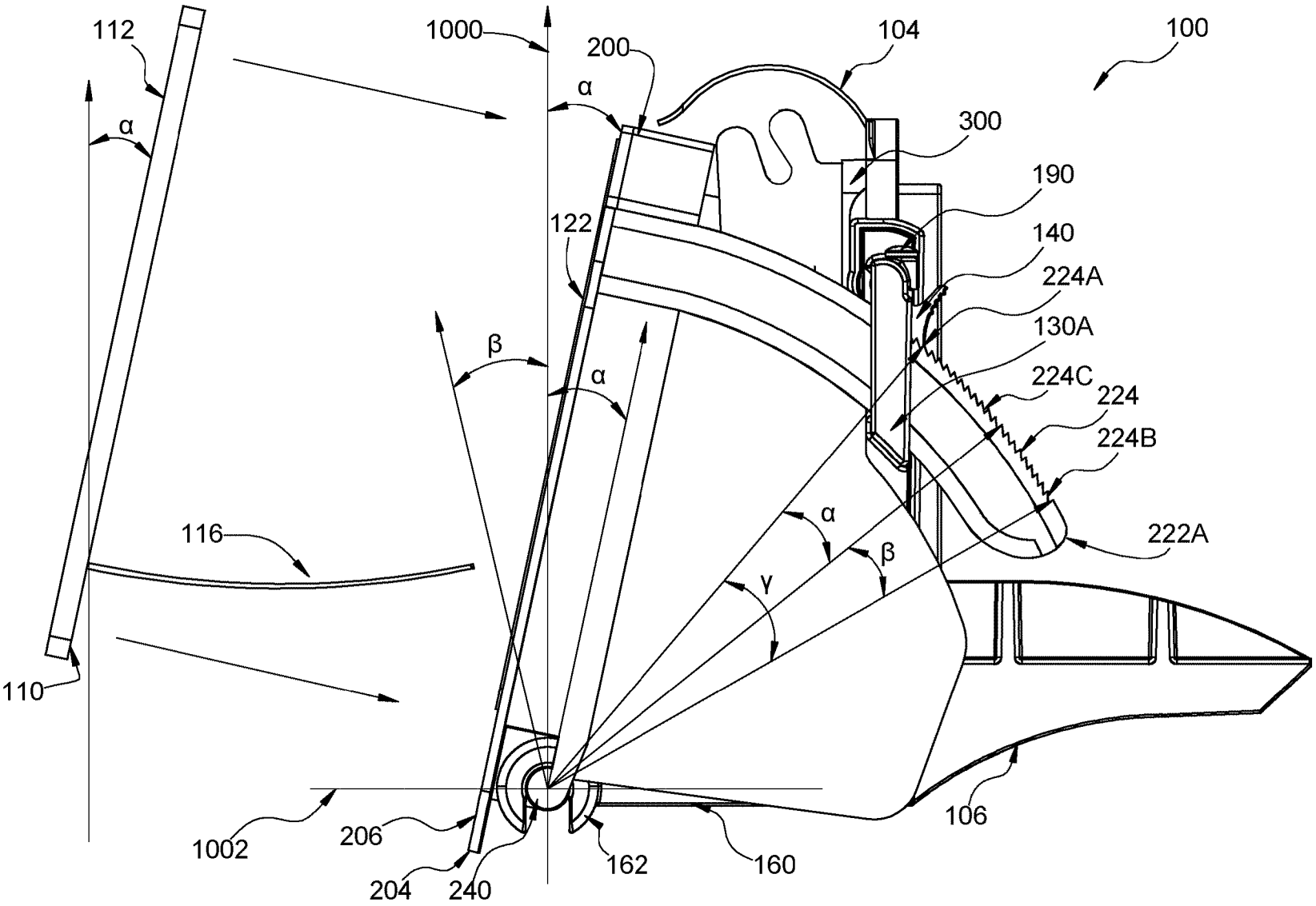
FIG. 11 is a right side partial-exploded view of the example adjustable-face skimmer interface module of FIG. 1A, with the finishing ring removed and face plate exploded to illustrate the axis of rotation of the pool-side mounting bracket.

FIGS. 6 and 7 depict the interface module 100 fully assembled, and showing the flow chamber 600, or the portion thereof that extends through the module 100 (the chamber extends proximally into the throat module, to the vessel of the skimmer). FIGS. 8-11 depict the same interface module 100, with some components removed to provide clarity as to how the components fit together. Referring to FIG. 11, with the hinge members 162, 240 matedly engaged, the axis of rotation is around the axis of the hinge (i.e., the axis of the shafts 242, see e.g. FIGS. 7 and 8); a vertical plane 1000 and a horizontal plane 1002 (both orthogonal to the page) are marked, and intersect at the axis of rotation (which is thus normal to the page). Additionally, specific teeth 224 are marked to emphasize the relationship to the articulation range—in the example: the full set of teeth 224 corresponds to the face 122 rotating incrementally through the full 20-degree angular range $\gamma$; a first tooth 224A that is the most distal of the teeth 224 represents the maximum proximal angle $\alpha$ of the face 122, and in the illustration the adjustment mechanism 240 is locked against the first tooth 224A; a last tooth 224B that is the most proximal of the teeth 224 represents the maximum distal angle $\beta$ of the face 122; and, the angles $\alpha$ and $\beta$ are measured as an offset from the vertical plane 1000, which corresponds to a locking position against a "vertical" tooth 224C, $\alpha+\beta=\gamma$. The face plate 110 will have the same angle of rotation as the face 122.

Figure 12A:
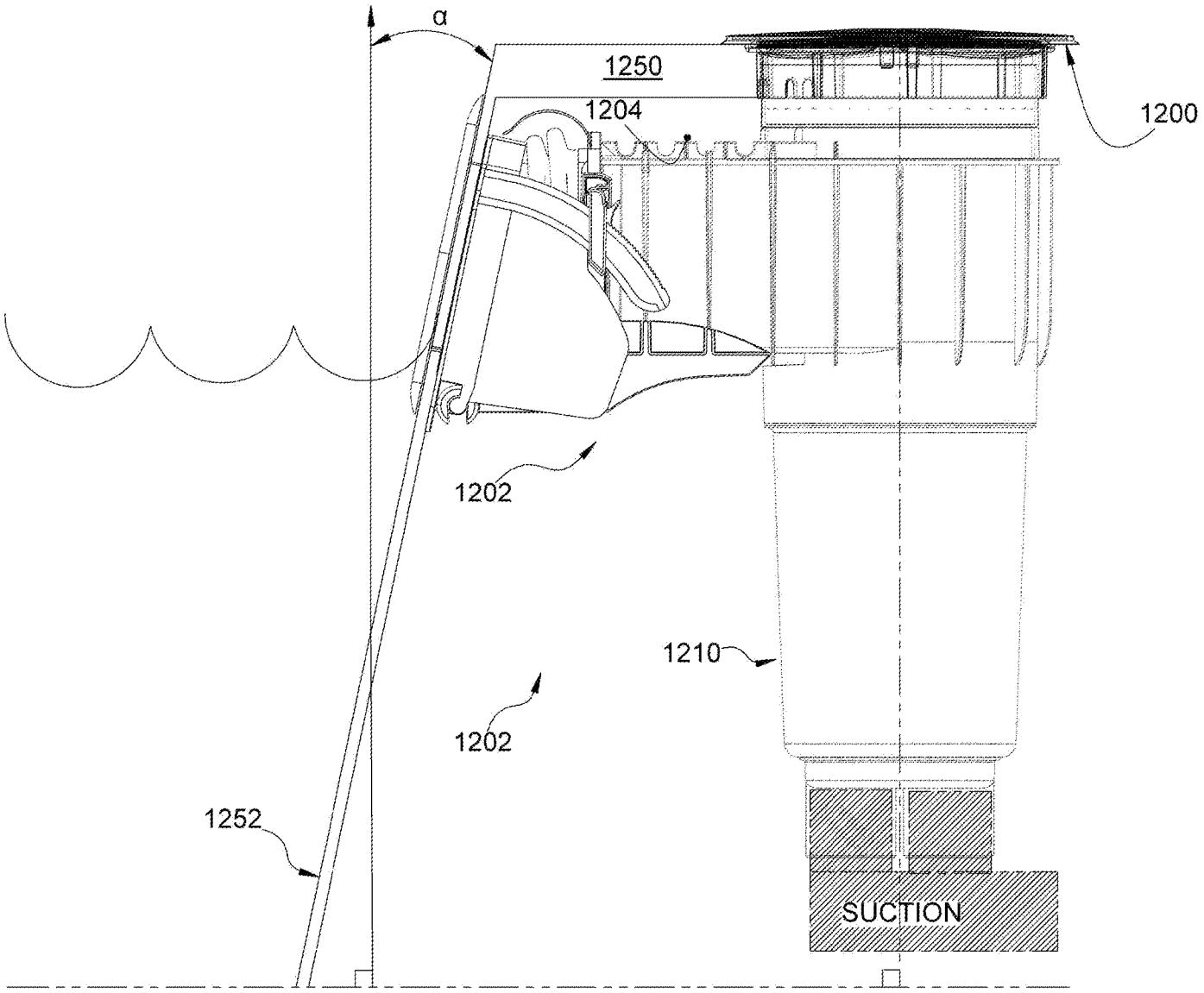
FIG. 12A is a right-side view of an example in-ground skimmer in accordance with the present disclosure, shown installed below a pool deck.
Figure 12B:
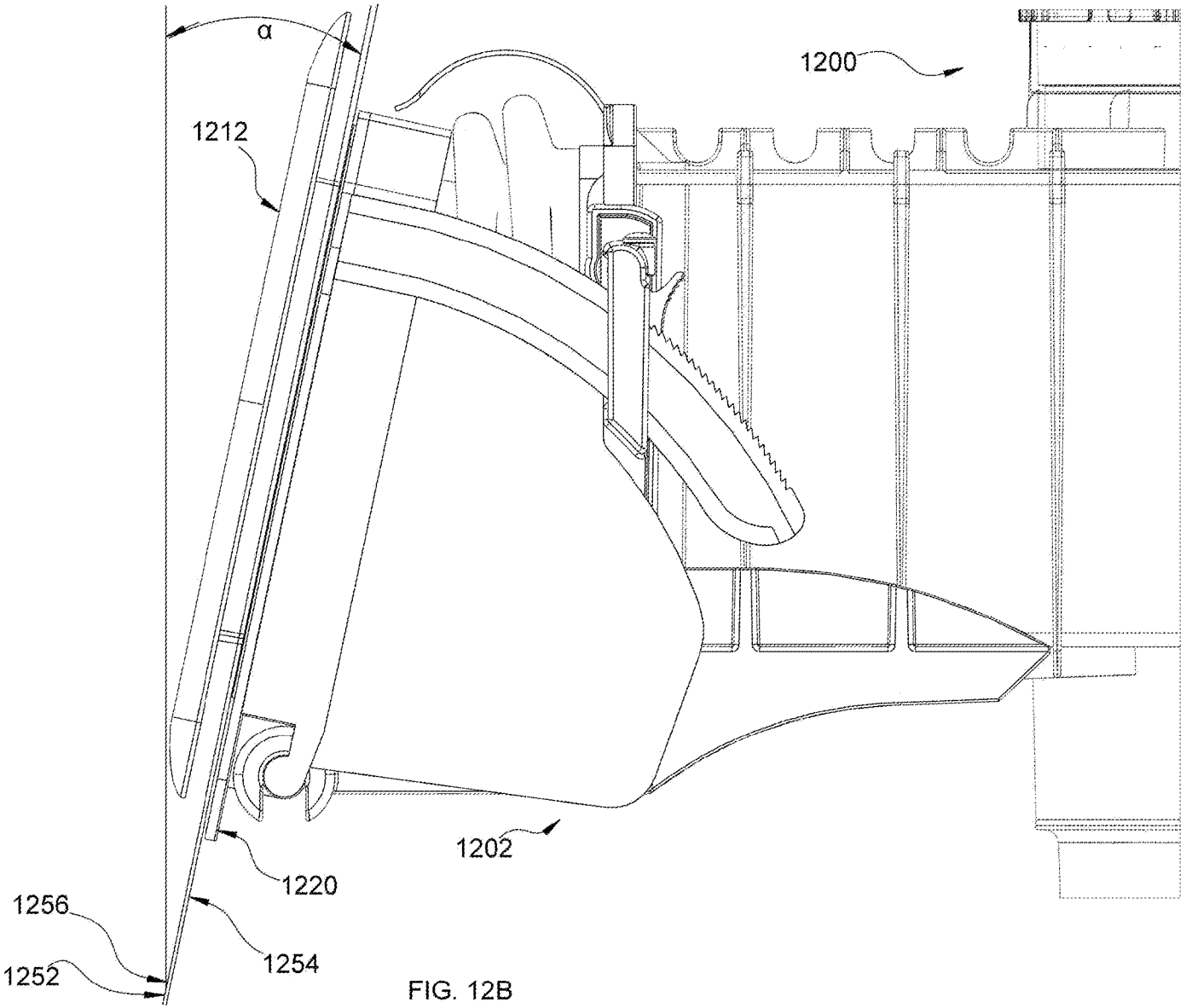
FIG. 12B is a close-up of the view of FIG. 12A, showing the interface module installed with a set angle that brings the adjustable face into flush contact with the pool wall.

Referring to FIGS. 12A and 12B, a skimmer 1200 in accordance with the present disclosure can be installed in an in-ground fiberglass pool, such as beneath/through the pool decking 1250, approximate the pool wall 1252. The skimmer 1200 includes an interface module 1202 as described above with reference to the interface module 100; the interface module 1202 can be attached to (e.g., via surface lamination) or integral with a throat 1204 of the skimmer 1200, which in turn interfaces with a vessel 1210 of the skimmer 1200 as described above. An installer determines the angle $\alpha$ of the pool wall 1252 with respect to vertical, and then adjusts the interface module 1202 so that the face of the mounting bracket 1220 is offset from vertical by the same angle $\alpha$. The installer can then place the mounting bracket 1220 in flush contact with the exterior surface 1254 of the pool wall 1252. On the inside of the pool, the installer positions the face plate (not shown; see face plate 110 of FIG. 11) on the interior surface 1256 of the pool wall 1252, and fastens the face plate to the mounting bracket 1220, securing the interface module 1202 to the pool wall 1252. A finishing cover 1212, such as the cover 150 described above or another aesthetic component, can be installed over the face plate to complete the interface with the pool wall 1252.

While various embodiments of the present invention have been illustrated and described in detail, it should be apparent that modifications and adaptations to those embodiments may occur to one skilled in the art without departing from the scope of the present invention.

What is claimed is:

1. A device for skimming a surface of a swimming pool or spa, the device comprising:

a first mounting bracket having a face that contacts a wall of the swimming pool or spa, the first mounting bracket being attached to or integral with a hinge and rotatable about an axis of the hinge to provide angular adjustment of the face;

a second mounting bracket positioned distally from the first mounting bracket and configured to be installed perpendicular to a water line of the swimming pool or spa, the first mounting bracket rotating relative to the second mounting bracket;

an adjustment mechanism mechanically coupled to the first and second mounting brackets and configured to lock the first mounting bracket at a desired angle, relative to a vertical plane parallel to the second mounting bracket, that allows flush contact of the face with the pool wall; and a flexible shroud comprising waterproof material, the shroud attached between the first and second mounting brackets to form a waterproof chamber extending from the face of the first mounting bracket through the shroud and the second mounting bracket.

2. The device of claim 1, wherein the second mounting bracket comprises one or more notches that receive corresponding tabs of a weir to attach the weir to the device in a position that rotatably occludes the chamber to allow water to flow distally past the weir and prevent water from flowing proximally past the weir.

3. The device of claim 1, wherein the adjustment mechanism comprises an adjustor base attached to or integral with a first side of the second mounting bracket, the adjustor base matedly cooperating with the first mounting bracket to allow the first mounting bracket to rotate and to be locked, using the adjustment mechanism, at the desired angle.

4. The device of claim 3, wherein:

the adjustment mechanism further comprises a resilient pawl attached to or integral with the adjustor base, the pawl comprising a first set of teeth; and the first mounting bracket comprises a body defining the face, and a gear member extending distally from the body into contact with the adjustment mechanism, the gear member comprising a second set of teeth that interface with the first set of teeth to form a ratcheting mechanism, the first mounting bracket being rotatable through an angular range defined by the second set of teeth.

5. The device of claim 3, wherein the adjustor base comprises a locking bore, the device further comprising a locking screw that threads through the locking bore and is tightened into contact with the first mounting bracket to lock the first mounting bracket at the desired angle.

6. The device of claim 3, wherein the second mounting bracket comprises a plurality of slots disposed through the first side, the adjustor base comprises a plurality of tabs arranged in alignment with the plurality of slots, and the adjustor base is secured to the second mounting bracket by friction fit of the plurality of tabs into the plurality of slots.

7. The device of claim 1, wherein the first and second mounting brackets each comprise a corresponding shroud channel, and the shroud is coupled to each of the first and second mounting brackets within the corresponding shroud channels via an overmolding process.

8. The device of claim 1, further comprising an upper shroud guard attached to the second mounting bracket and extending over a top of the shroud, the upper shroud guard comprising a material that is sufficiently rigid to deflect debris that would damage the shroud during installation of the device.

9. The device of claim 1, further comprising a support plate attached to each of the first and second mounting brackets and supporting the first mounting bracket to maintain the desired angle and the second mounting bracket to maintain a vertical orientation.

10. The device of claim 9, wherein the support plate comprises a mounting groove and the second mounting bracket comprises a body and one or more projections extending downward from the body, the one or more projections inserting into the mounting groove to attach the second mounting bracket to the support plate.

11. The device of claim 9, wherein the support plate comprises a first hinge member and the first mounting bracket comprises a second hinge member that cooperates with the first hinge member to form the hinge.

12. The device of claim 9, wherein the support plate comprises a throat support member that laminates to a throat module of a skimmer to integrate the device with the skimmer.

13. The device of claim 1, further comprising:

a vessel comprising one or more ports configuring the vessel to fluidly connect to a suction side of a cleaning system of the swimming pool or spa;

a throat module having a proximal end and a distal end, the throat module attached to or integral with the second mounting bracket at the proximal end, and the throat module attached to or integral with the vessel at the distal end, the throat module extending the chamber into fluid communication with the vessel; and a weir disposed in the chamber and configured to rotatably occlude the chamber to allow water to flow distally past the weir and to prevent water from flowing proximally past the weir.

14. The device of claim 1, further comprising a face plate comprising:

a mounting ring that attaches to the first mounting bracket through the wall to securely attach the device to the wall; and a lower shroud guard attached to or integral with the mounting ring and extending distally from the mounting ring into the chamber and over a bottom of the shroud.

15. The device of claim 14, further comprising a finishing cover comprising:

a finishing ring that attaches to the face plate to conceal the mounting ring; and one or more side shroud guards attached to or integral with the finishing ring and extending distally from the finishing ring into the chamber to cover the shroud.

16. A method of installing a skimmer for a swimming pool or spa, the method comprising:

positioning, adjacent to an exterior surface of a wall of the swimming pool or spa, and approximate an aperture through the wall for mounting the skimmer, an interface module comprising:

a first mounting bracket including a planar face on its proximal side, the first mounting bracket being rotatable about an axis to provide angular adjustment of the face, wherein positioning the interface module comprises orienting the face toward the wall;

a second mounting bracket positioned distally from the first mounting bracket, the first mounting bracket rotating relative to the second mounting bracket;

a flexible shroud comprising waterproof material, the shroud attached between the first and second mounting brackets to form a waterproof chamber through the interface module, the shroud sufficiently expanding and contracting as the first mounting bracket is rotated to keep the chamber waterproof; and an adjustment mechanism mechanically coupled to the first and second mounting brackets to releasably lock rotation of the first mounting bracket;

actuating the adjustment mechanism to release the first mounting bracket into rotation;

rotating the first mounting bracket to a desired angle, relative to the second mounting bracket, that allows flush contact of the face with the exterior surface of the wall around a perimeter of the aperture through the wall;

actuating the adjustment mechanism to lock the first mounting bracket at the desired angle; and securing the interface module to the wall of the swimming pool with the face in contact with the exterior surface around the aperture and the second mounting bracket perpendicular to a water line of the swimming pool or spa.

17. The method of claim 16, wherein:

the actuating mechanism comprises a base, a resilient pawl attached to or integral with the base, and a thumb-operable actuator attached to or integral with the pawl;

the first mounting bracket comprises a body defining the face, and a gear member extending distally from the body into mechanical communication with the actuating mechanism; the gear member cooperating with the pawl to form a ratcheting mechanism; and actuating the adjustment mechanism to release the first mounting bracket into rotation comprises applying force to the actuator to lift the pawl away from the gear member.

18. The method of claim 17, wherein the adjustment mechanism further comprises a bore and a screw threaded with the bore, and wherein actuating the adjustment mechanism to lock the first mounting bracket at the desired angle comprises:

removing the force from the actuator so the pawl re-engages the gear member with the first mounting bracket rotated to the desired angle; and tightening the screw through the bore into contact with the first mounting bracket.

19. The method of claim 16, further comprising laminating the second mounting bracket to a throat module of the skimmer to extend the chamber distally through the throat module to a vessel of the skimmer.

20. The method of claim 19, wherein:

the interface module further comprises a support plate including an assembly support member, a first hinge member extending proximally from the assembly support member, and a throat support member extending distally from the assembly support member;

the first mounting bracket comprises a body defining the face, and a second hinge member extending downward from a bottom of the body and cooperating with the first hinge member to form a hinge at the axis of rotation of the first mounting bracket; and the second mounting bracket is attached to the assembly support member to position the second mounting bracket parallel to the vertical plane;

the method further comprising laminating the throat module to the throat support member.

* * * * *